US008960285B2

(12) United States Patent
Parsche

(10) Patent No.: US 8,960,285 B2
(45) Date of Patent: Feb. 24, 2015

(54) METHOD OF PROCESSING A HYDROCARBON RESOURCE INCLUDING SUPPLYING RF ENERGY USING AN EXTENDED WELL PORTION

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 587 days.

(21) Appl. No.: 13/286,576

(22) Filed: Nov. 1, 2011

(65) Prior Publication Data

US 2013/0105155 A1 May 2, 2013

(51) Int. Cl.
*E21B 43/24* (2006.01)

(52) U.S. Cl.
CPC ..... *E21B 43/2401* (2013.01); *E21B 43/2408* (2013.01)
USPC ..... 166/272.1; 166/248; 166/302; 166/272.3

(58) Field of Classification Search
CPC .. E21B 43/2401; E21B 43/2406; E21B 36/04
USPC ..... 166/272.1, 248, 302, 272.3
See application file for complete search history.

(56) References Cited

U.S. PATENT DOCUMENTS

| | | | | |
|---|---|---|---|---|
| 3,932,365 | A | 1/1976 | Penisson | 260/78 R |
| 3,948,666 | A | 4/1976 | Kitanishi et al. | 96/115 P |
| RE28,868 | E | 6/1976 | Spaeder, Jr. | 29/148.4 |
| 4,064,062 | A | 12/1977 | Yurko | 252/99 |
| 4,140,180 | A | 2/1979 | Bridges et al. | 166/248 |
| 4,144,935 | A | 3/1979 | Bridges et al. | 166/248 |
| 4,206,100 | A | 6/1980 | Kyo et al. | 260/22 R |
| 4,231,535 | A | 11/1980 | Schlegel et al. | 244/110 |
| 4,258,154 | A | 3/1981 | Kyo et al. | 525/425 |
| 4,390,410 | A | 6/1983 | Audeh | 208/8 LE |
| 4,438,293 | A | 3/1984 | Voser | 174/79 |
| 4,505,100 | A | 3/1985 | Yoshiyuki et al. | 57/207 |
| 4,513,815 | A | 4/1985 | Rundell et al. | |
| 4,645,585 | A | 2/1987 | White | 208/58 |
| 4,699,841 | A | 10/1987 | Kundinger et al. | 428/332 |
| 4,705,720 | A | 11/1987 | Kundinger et al. | 428/332 |
| 4,789,718 | A | 12/1988 | Noll et al. | 528/49 |
| 4,806,375 | A | 2/1989 | Favre | 426/433 |
| 4,985,193 | A | 1/1991 | Allen | 264/184 |
| 5,046,559 | A | 9/1991 | Glandt | 166/248 |
| 5,124,436 | A | 6/1992 | Keil et al. | 528/331 |
| 5,232,605 | A | 8/1993 | Baur et al. | 210/761 |
| 5,463,003 | A | 10/1995 | Horikawa et al. | 526/176 |
| 5,463,004 | A | 10/1995 | Horikawa | 526/176 |

(Continued)

*Primary Examiner* — Nicole Coy
(74) *Attorney, Agent, or Firm* — Allen, Dyer, Doppelt, Milbrath & Gilchrist, P.A.

(57) ABSTRACT

A method for hydrocarbon resource recovery in a subterranean formation including a laterally extending injector well having a tubular conductor therein, and a laterally extending producer well adjacent the injector well, may include drilling outwardly from a distal end of the injector well beyond a distal end of the tubular conductor to define an extended injector well portion. The method may further include advancing a radio frequency (RF) conductor through the tubular conductor so as to extend beyond the distal end of the tubular conductor and into the extended injector well portion. The method may further include supplying RF energy into adjacent portions of the subterranean formation from the RF conductor, and recovering hydrocarbon resources utilizing the producer well.

18 Claims, 19 Drawing Sheets

(56) References Cited

U.S. PATENT DOCUMENTS

| | | | | |
|---|---|---|---|---|
| 5,863,362 | A | 1/1999 | Creech | 152/527 |
| 6,103,059 | A | 8/2000 | Call | 162/65 |
| 6,156,867 | A | 12/2000 | Aoyama et al. | 528/282 |
| 6,159,121 | A | 12/2000 | Giacomo et al. | 474/205 |
| 6,200,046 | B1 | 3/2001 | Rylander | 401/52 |
| 6,344,518 | B1 | 2/2002 | Kobayashi et al. | 524/862 |
| 6,362,272 | B1 | 3/2002 | Tadaki et al. | 524/555 |
| 6,548,598 | B2 | 4/2003 | Takeuchi et al. | 525/68 |
| 6,673,423 | B2 | 1/2004 | Kranenburg-Van Dijk et al. | |
| 6,875,825 | B2 | 4/2005 | Kaneko et al. | 525/526 |
| 6,942,757 | B1 | 9/2005 | Iwama et al. | 162/157.3 |
| 7,230,062 | B2 | 6/2007 | Mouri et al. | 525/113 |
| 7,288,690 | B2 | 10/2007 | Bellet et al. | 585/648 |
| 7,441,597 | B2 | 10/2008 | Kasevich | 166/247 |
| 7,468,342 | B2 | 12/2008 | Kanamori et al. | 502/327 |
| 7,484,561 | B2 | 2/2009 | Bridges | 166/248 |
| 7,747,388 | B2 | 6/2010 | Mombourquette et al. | 702/11 |
| 7,891,421 | B2 * | 2/2011 | Kasevich | 166/247 |
| 2009/0050318 | A1 | 2/2009 | Kasevich | |
| 2009/0283257 | A1 | 11/2009 | Becker | 166/248 |
| 2010/0218940 | A1 | 9/2010 | Parsche | 166/248 |
| 2010/0219105 | A1 | 9/2010 | White et al. | 208/391 |
| 2010/0219107 | A1 | 9/2010 | Parsche | 208/402 |
| 2010/0219108 | A1 | 9/2010 | Parsche | 208/402 |
| 2010/0219182 | A1 | 9/2010 | Parsche | 219/660 |
| 2010/0219184 | A1 | 9/2010 | Parsche | 219/747 |
| 2010/0223011 | A1 | 9/2010 | Parsche | 702/11 |
| 2012/0061080 | A1 * | 3/2012 | Sultenfuss et al. | 166/302 |

* cited by examiner

METHOD OF PROCESSING A HYDROCARBON RESOURCE INCLUDING SUPPLYING RF ENERGY USING AN EXTENDED WELL PORTION

FIELD OF THE INVENTION

The present invention relates to the field of hydrocarbon resource processing, and, more particularly, to hydrocarbon resource processing including radio frequency application.

BACKGROUND OF THE INVENTION

A hydrocarbon resource may be particularly valuable as a fuel, for example, gasoline. One particular hydrocarbon resource, bitumen, may be used as a basis for making synthetic crude oil, which may be refined into gasoline by a process called upgrading. Accordingly, bitumen, for example, may be relatively valuable. More particularly, to produce 350,000 barrels a day of bitumen based synthetic crude oil would equate to about 1 billion dollars a year in bitumen. Moreover, about 8% of U.S. transportation fuels, e.g., gasoline, diesel fuel, and jet fuel, are synthesized or based upon synthetic crude oil.

In the hydrocarbon upgrading or cracking process, hydrogen is added to carbon to make gasoline, so, in the case of bitumen, natural gas is added to the bitumen. Natural gas provides the hydrogen. Bitumen provides the carbon. Certain ratios and mixes of carbon and hydrogen are gasoline, about 8 carbons to 18 hydrogens, e.g. $CH_3(CH_2)_6CH_3$. Gasoline is worth more then either bitumen or natural gas, and thus the reason for its synthesis.

One process for cracking the hydrocarbons is fluid catalytic cracking (FCC). In the FCC process, hot bitumen is applied to a catalyst, for example, $AlO_2$, at 900° C. with a relatively small amount of water to form synthetic crude oil. The water may donate hydroxyl radicals, OH—, to enhance the reaction. However, the FCC process has a limited efficiency, about 70%. The residual, also known as coke, is worth far less. Moreover, coke residues stop the FCC process, and there is an increased risk of fires and explosions. The FCC process also has a poor molecular selectivity, and produces relatively high reactant emissions, especially ammonia. The catalyst used in the FCC process also has a relatively short lifespan.

Several references disclose application of RF energy to a hydrocarbon resource to heat the hydrocarbon resource, for example, for cracking. In particular, U.S. Patent Application Publication No. 2010/0219107 to Parsche, which is assigned to the assignee of the present application and incorporated herein by reference, discloses a method of heating a petroleum ore by applying RF energy to a mixture of petroleum ore and susceptor particles. U.S. Patent Application Publication Nos. 2010/0218940, 2010/0219108, 2010/0219184, 2010/0223011 and 2010/0219182, all to Parsche, and all of which are assigned to the assignee of the present application and incorporated herein by reference, disclose related apparatus for heating a hydrocarbon resource by RF energy. U.S. Patent Application Publication No. 2010/0219105 to White et al. discloses a device for RF heating to reduce use of supplemental water added in the recovery of unconventional oil, for example, bitumen.

Several references disclose applying RF energy at a particular frequency to crack the hydrocarbon resource. U.S. Pat. No. 7,288,690 to Bellet at al. discloses induction heating at frequencies in the range of 3-30 MHz. U.S. Patent Application Publication No. 2009/0283257 to Becker discloses treating an oil well at a frequency range of 1-900 MHz and no more than 1000 Watts, using a dipole antenna, for example.

U.S. Pat. No. 7,891,421 to Kasevich discloses an apparatus for in-situ RF heating. The apparatus includes a cylindrically shaped radiating element that is configured to allow the passage of fluids therethrough. A coaxial cable couples the radiating element to an RF source. A choke assembly is coupled between the radiating element and the RF source to increase transmission of RF energy to the radiating element.

Further improvements to hydrocarbon resource upgrading may be desirable, and, in particular, to in-situ hydrocarbon resource upgrading. For example, it may be desirable to increase the efficiency of the bitumen to gasoline conversion process, i.e. upgrading, by making it quicker and cheaper and with a reduced amount of additional resources. In particular, it may be desirable to recover hydrocarbon resources that may be left behind in a well that may have been capped or abandoned, for example.

SUMMARY OF THE INVENTION

In view of the foregoing background, it is therefore an object of the present invention to increase the efficiency of in-situ hydrocarbon resource recovery.

This and other objects, features, and advantages in accordance with the present invention are provided by a method for hydrocarbon resource recovery in a subterranean formation including a laterally extending injector well having a tubular conductor therein, and a laterally extending producer well adjacent the injector well. The method includes drilling outwardly from a distal end of the injector well beyond a distal end of the tubular conductor to define an extended injector well portion. The method also includes advancing at least one radio frequency (RF) conductor through the tubular conductor so as to extend beyond the distal end of the tubular conductor and into the extended injector well portion. The method further includes supplying RF energy into adjacent portions of the subterranean formation from the RF conductor, and recovering hydrocarbon resources from the producer well. Accordingly, the method may provide increased efficiency in hydrocarbon resource recovery and/or upgrading, in-situ, by using or reusing existing infrastructure with RF heating.

Recovering hydrocarbon resources may include recovering hydrocarbon resources using Steam Assisted Gravity Drainage (SAGD) via the injector well and producer well, for example. The subterranean formation may include an oil sand formation, for example.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The present invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

As used in this application, the term "or" is intended to mean an inclusive "or" rather than an exclusive "or". That is, unless specified otherwise, or clear from context, "X employs A or B" is intended to mean any of the natural inclusive permutations. That is if, X employs A; X employs B; or X employs both A and B, then "X employs A or B" is satisfied under any of the foregoing instances.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Referring initially to the flowchart 40 in FIG. 1 and FIGS. 2*a*-2*d*, beginning at Block 42, a method of heating a hydrocarbon resource recovery in a subterranean formation 21 is described. The hydrocarbon resource may be in a subterranean formation 21, such as an oil sand formation for example.

Figure 1:
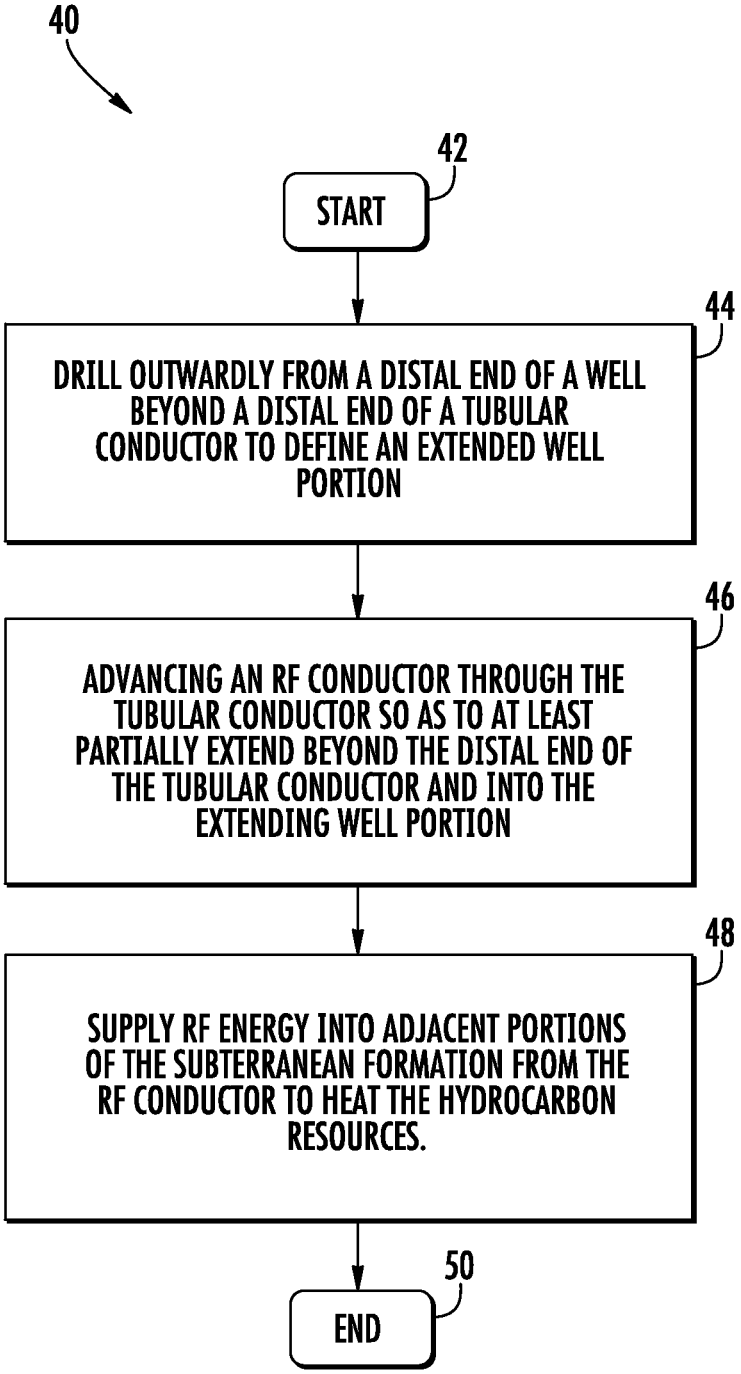
FIG. 1 is flow chart of a method of hydrocarbon resource recovery in accordance with the present invention.
Figure 2A:
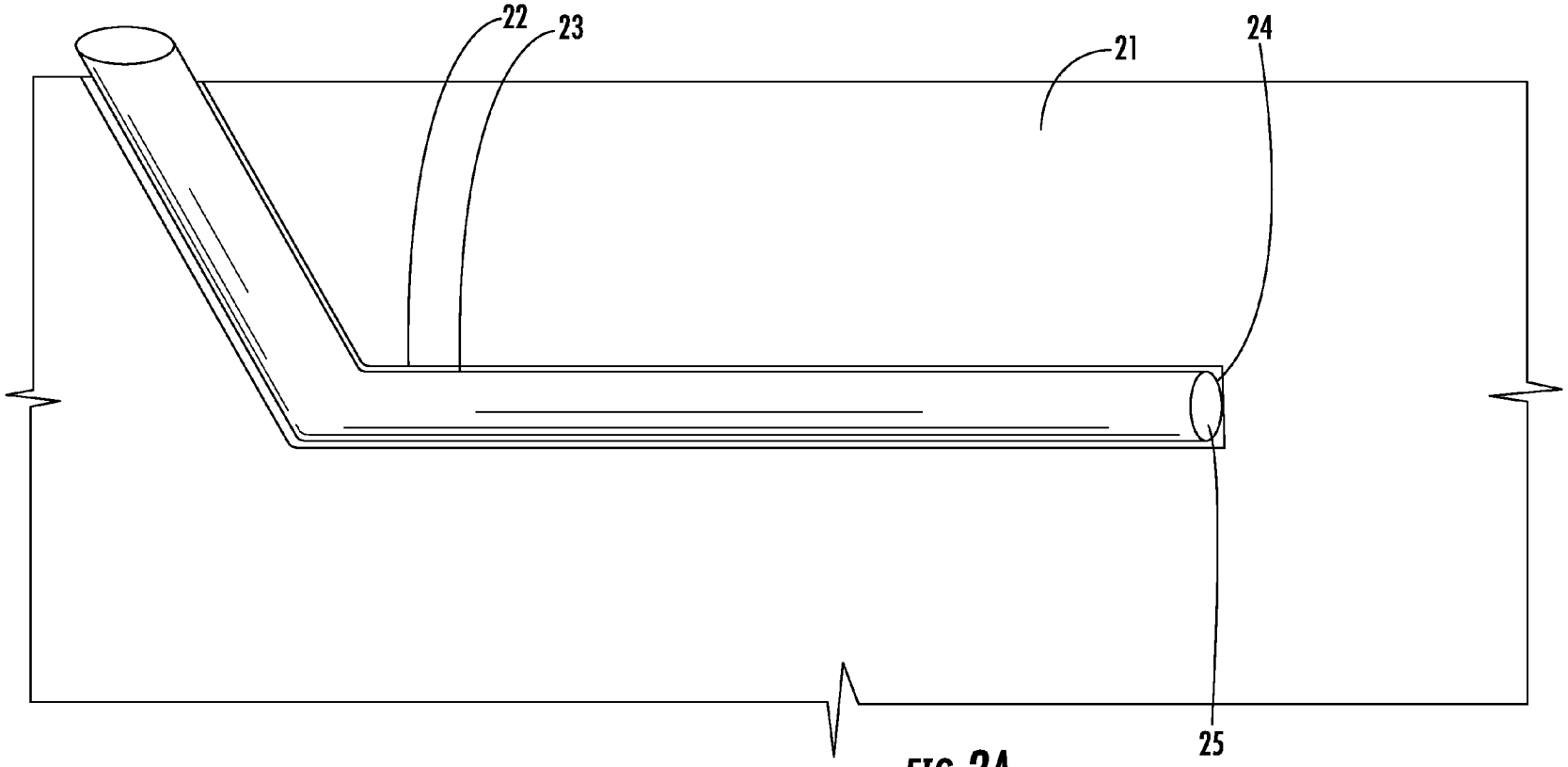
FIGS. 2*a*-2*d* are cross-sectional views of a subterranean formation at the different method steps illustrated in the flowchart of FIG. 1.

The subterranean formation 21 includes a laterally extending well 22 having a tubular conductor 23 therein (FIG. 2*a*). The tubular conductor 23 may be in the form of a pipe, for example, and may be considered a legacy pipe. In other words, at one point, the tubular conductor 23 may have been used in a hydrocarbon resource recovery process, but was subsequently abandoned, for example, because of a failure or because the hydrocarbon could no longer be recovered using other recovery methods. The tubular conductor 23 may be a ferrous conductive material, for example, steel. Of course, the tubular conductor 23 may be another material or materials.

Figure 2B:
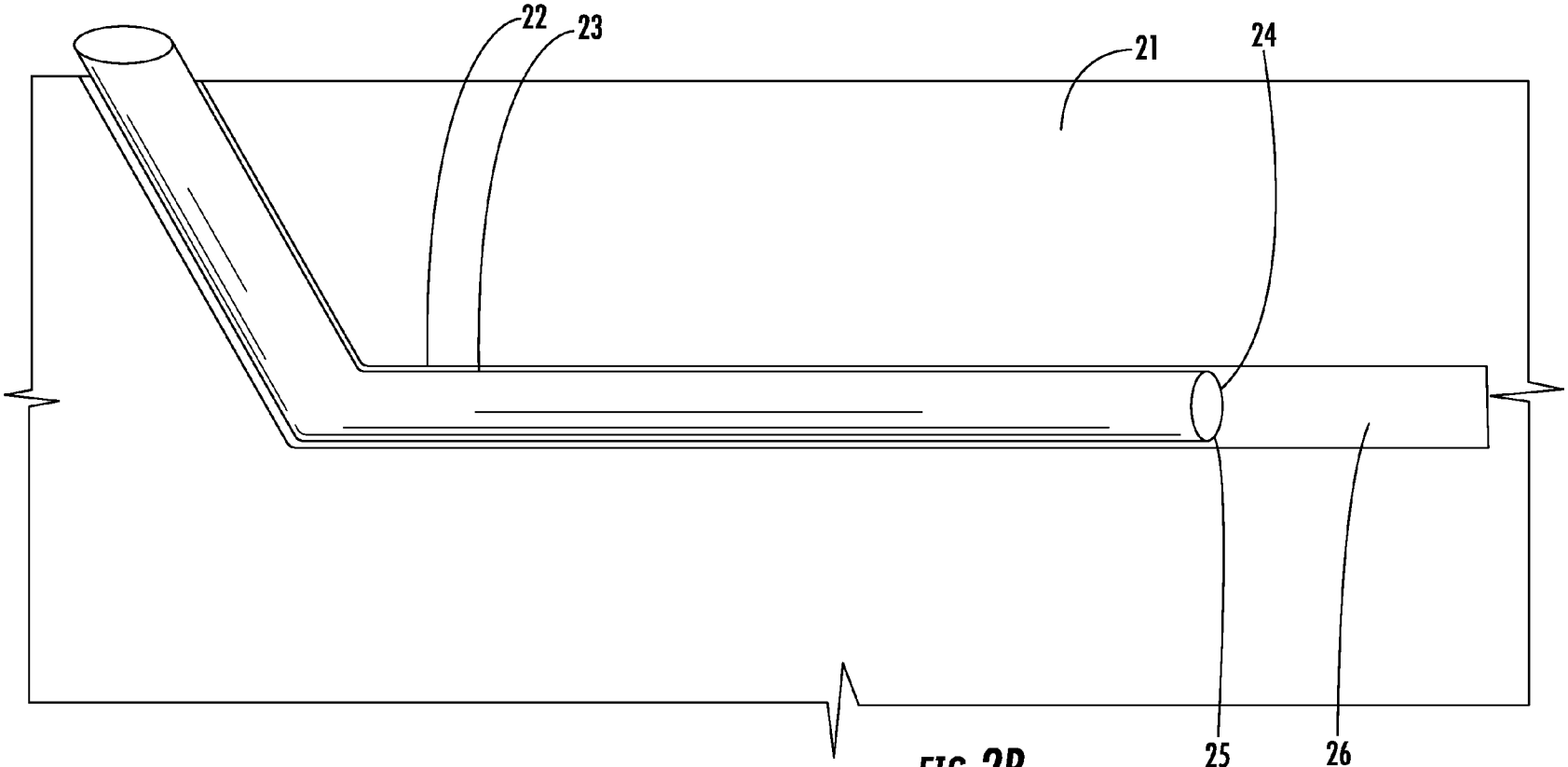

The method includes, at Block 44 drilling outwardly from a distal end 24 of the well 22 beyond a distal end 25 of the tubular conductor 23 to define an extended well portion 26 (FIG. 2*b*). As will be appreciated by those skilled in the art, various techniques for drilling may be used. Moreover, hydrocarbon resources may not be present adjacent the extended well portion 26. The extended well portion 26 may be drilled to allow RF heating along in the unextended portion of the well. This is because extending the well 22 allows an RF heating antenna to be formed in place, for example.

Figure 2C:
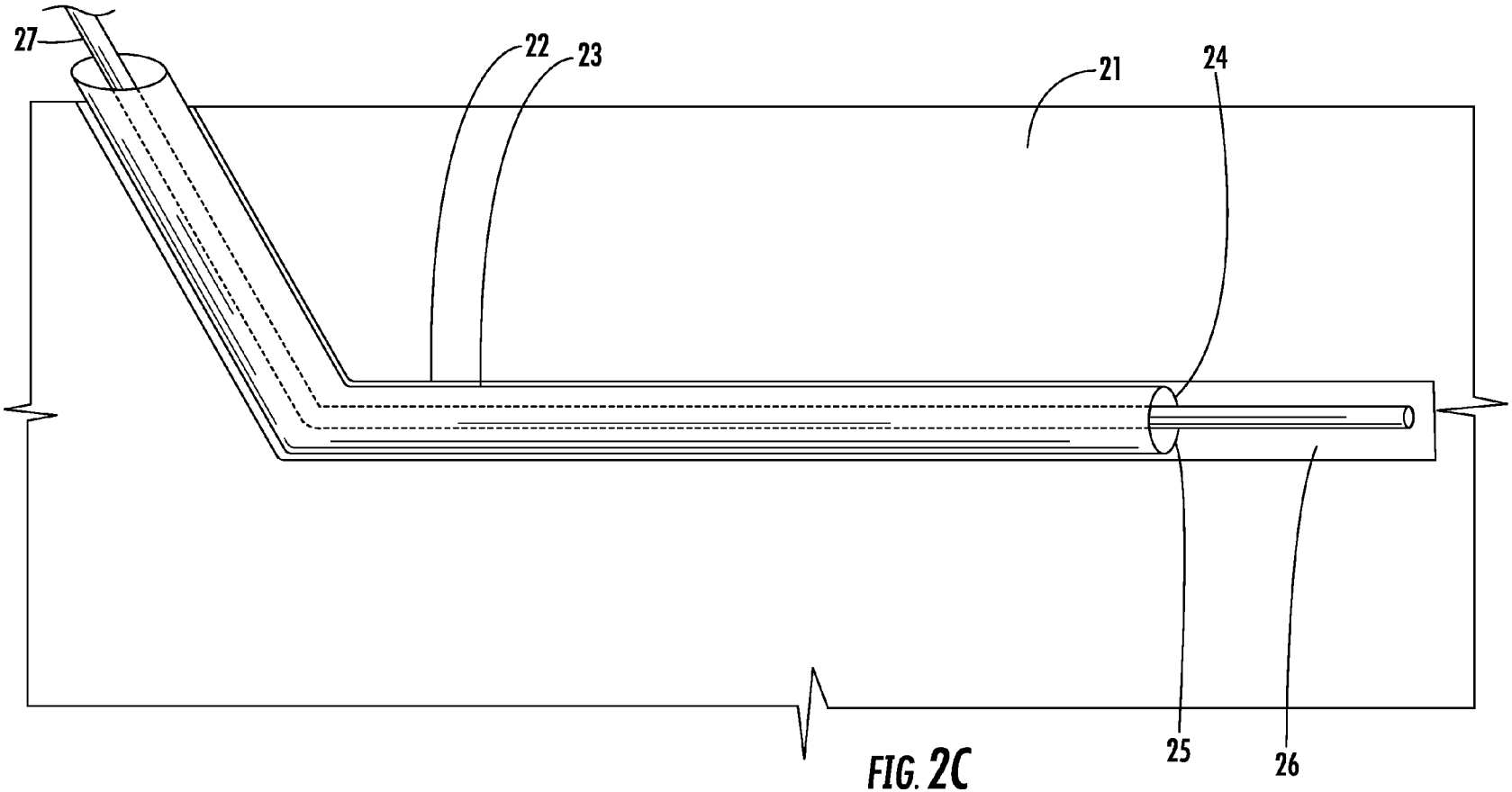
Figure 2D:
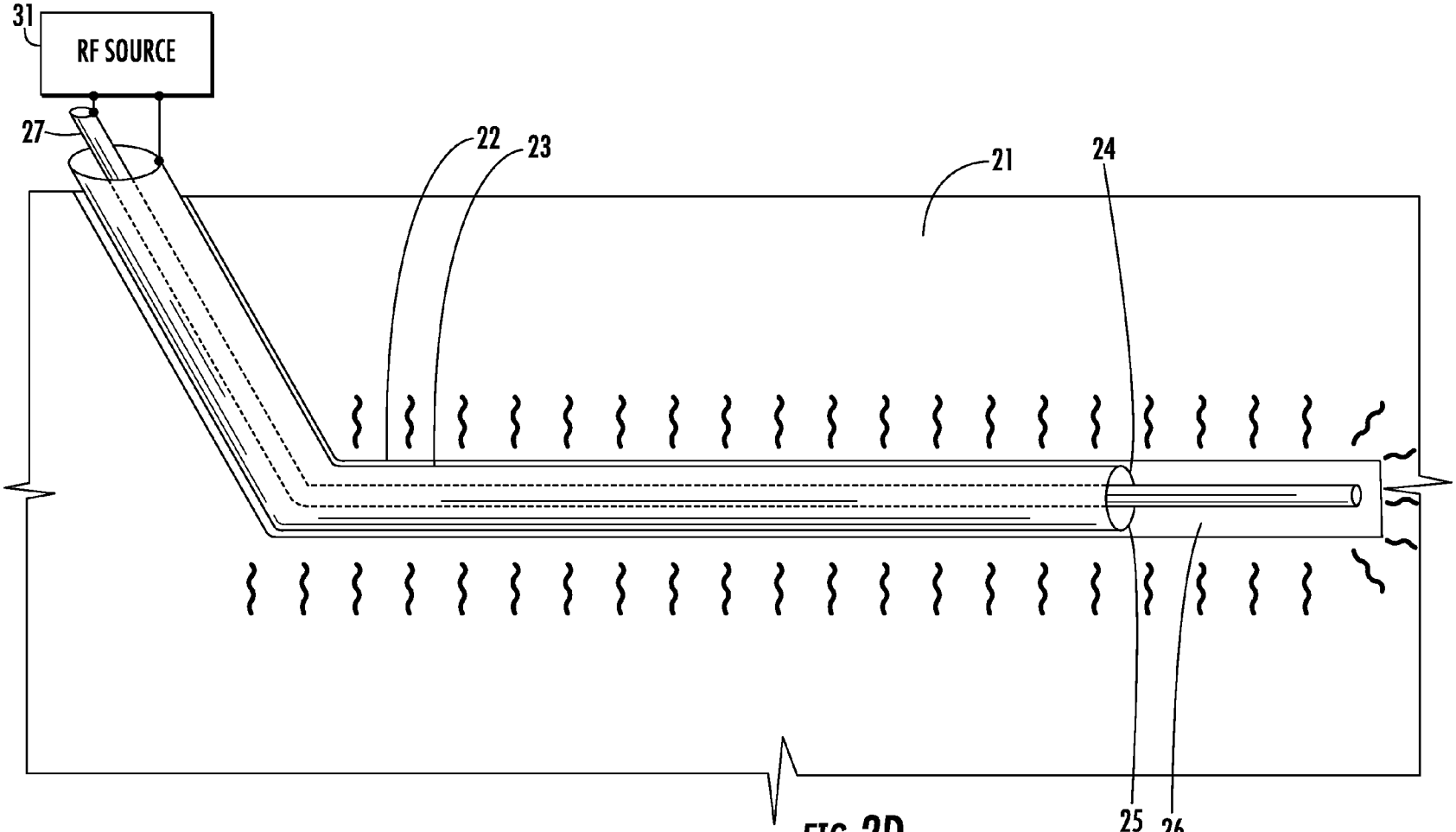
Figure 3:
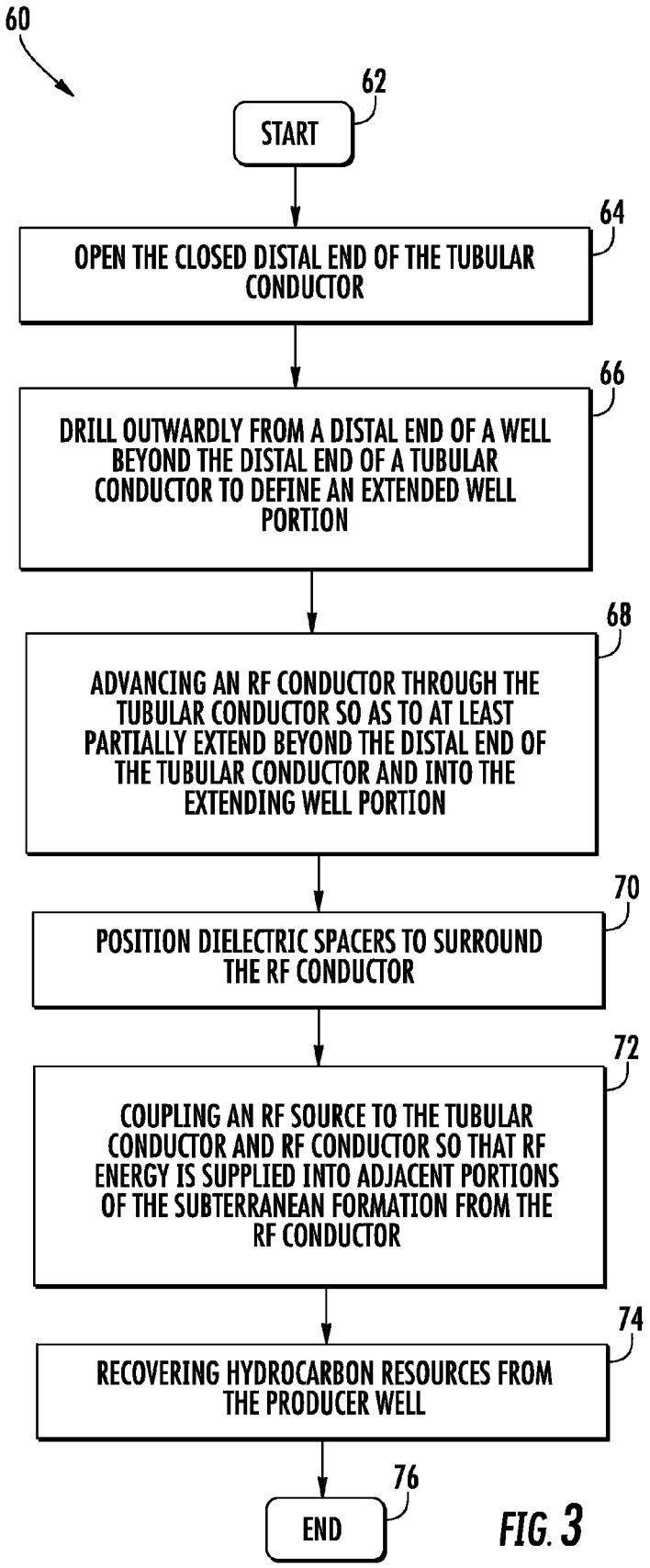
FIG. 3 is a more detailed flow chart of a method of hydrocarbon resource recovery in accordance with the present invention.

At Block 46, the method includes advancing a radio frequency (RF) conductor 27 through the tubular conductor 23 so as to extend beyond the distal end 24 of the tubular conductor 23 and into the extended well portion 26 (FIG. 2*c*). Implementing an RF conductor 27 in the extended well portion 26 forces RF currents back over the outside of the tubular conductor 23, so the un-extended well portions are RF heated. Thus, extending the well 22, as noted above, advantageously provides RF heating in legacy portions of an existing well. More than one RF conductor 27 may advance through the tubular conductor 23. The RF conductor 27 may be in the form of a conductive pipe or tube, a cable, a coaxial cable, or a litz wire, for example. The RF conductor 27 may be copper or steel. The RF conductor 27 may be another material or materials, or may be in other forms. Inside the tubular conductor 23, the RF conductor 27 may provide a coaxial transmission line therein. Beyond the distal end 25 of tubular conductor 23, RF conductor 27 may provide an antenna element.

The method further includes supplying RF energy into adjacent portions of the subterranean formation 21 from the RF conductor 27 to heat the hydrocarbon resources (FIG. 2*d*) (Block 48). While not being bound by a specific theory of operation, the mechanisms of the RF electromagnetic heating may include: joule effect heating by application of electric currents, joule effect heating by induction of eddy electric currents by application magnetic fields, joule effect heating by capacitive coupling of electric fields, and dielectric heating by application of electric fields. Resistive, joule effect heating of the antenna metal conductors is also possible, but is not a preferred method. For increased speed, it may be preferential that the subterranean formation 21 heat from within rather than by conductively from the tubular conductor 23. The primary radio frequency heating susceptor can be the connate water diffused in the subterranean formation 21, which joule effect heats, and then the heated water conductively heats the hydrocarbons. If hydrocarbon resources and water are mixed together, the water may RF heat about 100 or more times faster than the hydrocarbon resources at most radio frequencies. If water is not present, the sands, shales or hydrocarbons may be heated by dielectric heating, usually at frequencies above 1000 Mhz, for example.

As will be appreciated by those skilled in the art, supplying RF energy may advantageously upgrade the hydrocarbon resources in the adjacent portions of the subterranean formation 21. By upgrading is meant heating to lower the viscosity and or fracturing the hydrocarbon resources. An RF source 31 coupled to the RF conductor 27 and the tubular conductor 23 advantageously supplies the RF energy. The RF source 31 may be positioned above the subterranean formation, for example. The method ends at Block 50.

Referring now to the flowchart 60 in FIG. 3 and FIGS. 4*a*-4*f*, beginning at Block 62, a method for hydrocarbon resource recovery in a subterranean formation 21' is described. As noted above, the hydrocarbon resource may be in a subterranean formation of 21' such as oil sand formation. The subterranean formation 21' includes a laterally extending injector well 22' having a tubular conductor 23' therein. The subterranean formation 21' also includes a laterally extending producer well 32' adjacent the injector well 22'. The laterally extending producer well 32' may be positioned below and spaced apart from the laterally extending injector well 22', and may also include a tubular conductor 38' therein. The arrangement of the laterally extending injector well 22' and the laterally extending producer well 32' may be particularly advantageous for hydrocarbon resource recovery using SAGD.

Figure 4A:
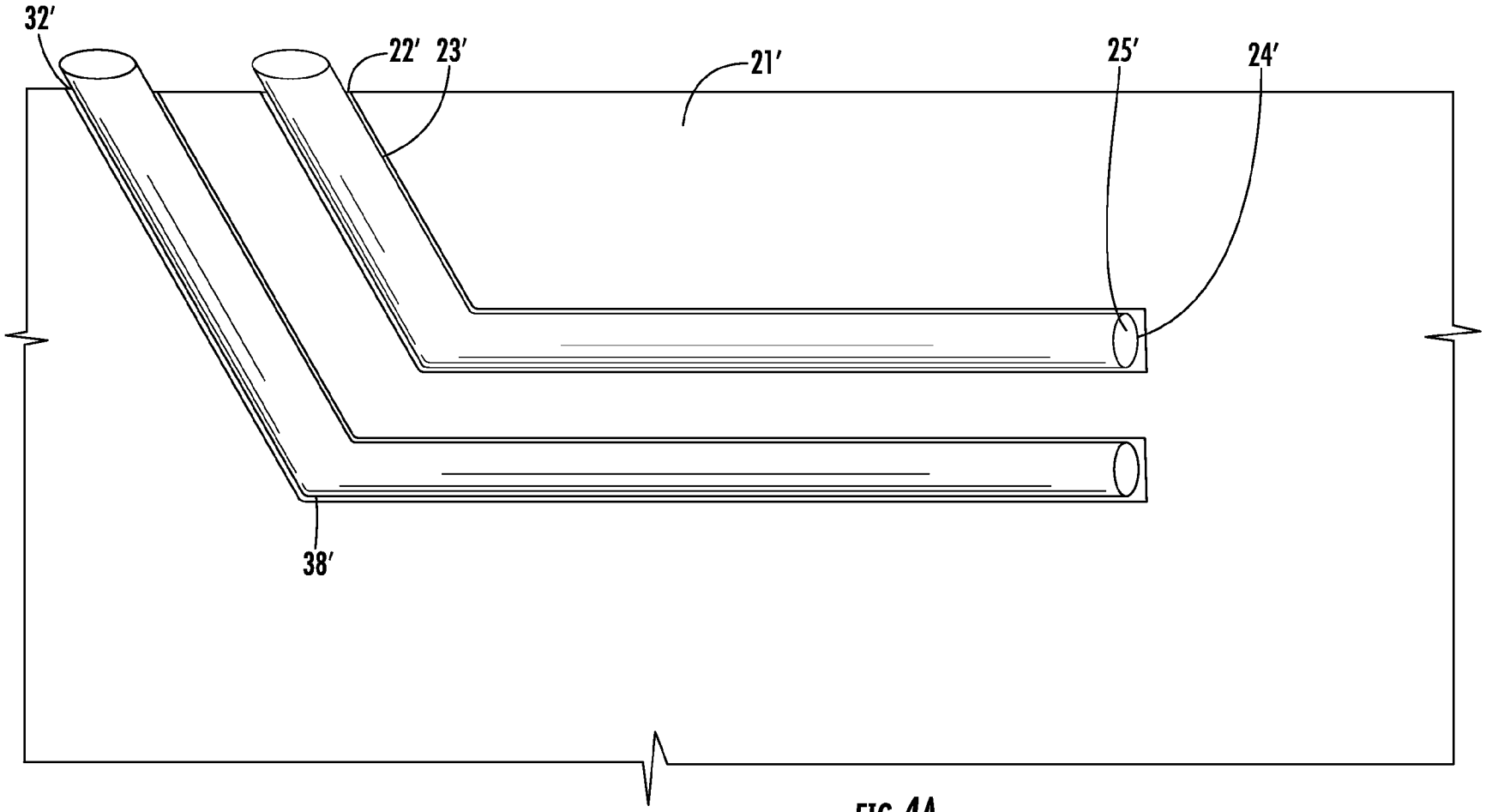
FIGS. 4*a*-4*f* are cross-sectional views of a subterranean formation at the different method steps illustrated in the flowchart of FIG. 3.

As noted above, the tubular conductor 23' may be in the form of a pipe, for example, and may be considered a legacy pipe, and may have been abandoned. Accordingly, the tubular conductor 23' may be closed at a distal end 25' thereof (FIG. 4*a*). For example, the tubular conductor 23' may have been capped or sealed at the distal end 25'. Of course, in some embodiments, the tubular conductor 23' may be open.

Figure 4B:
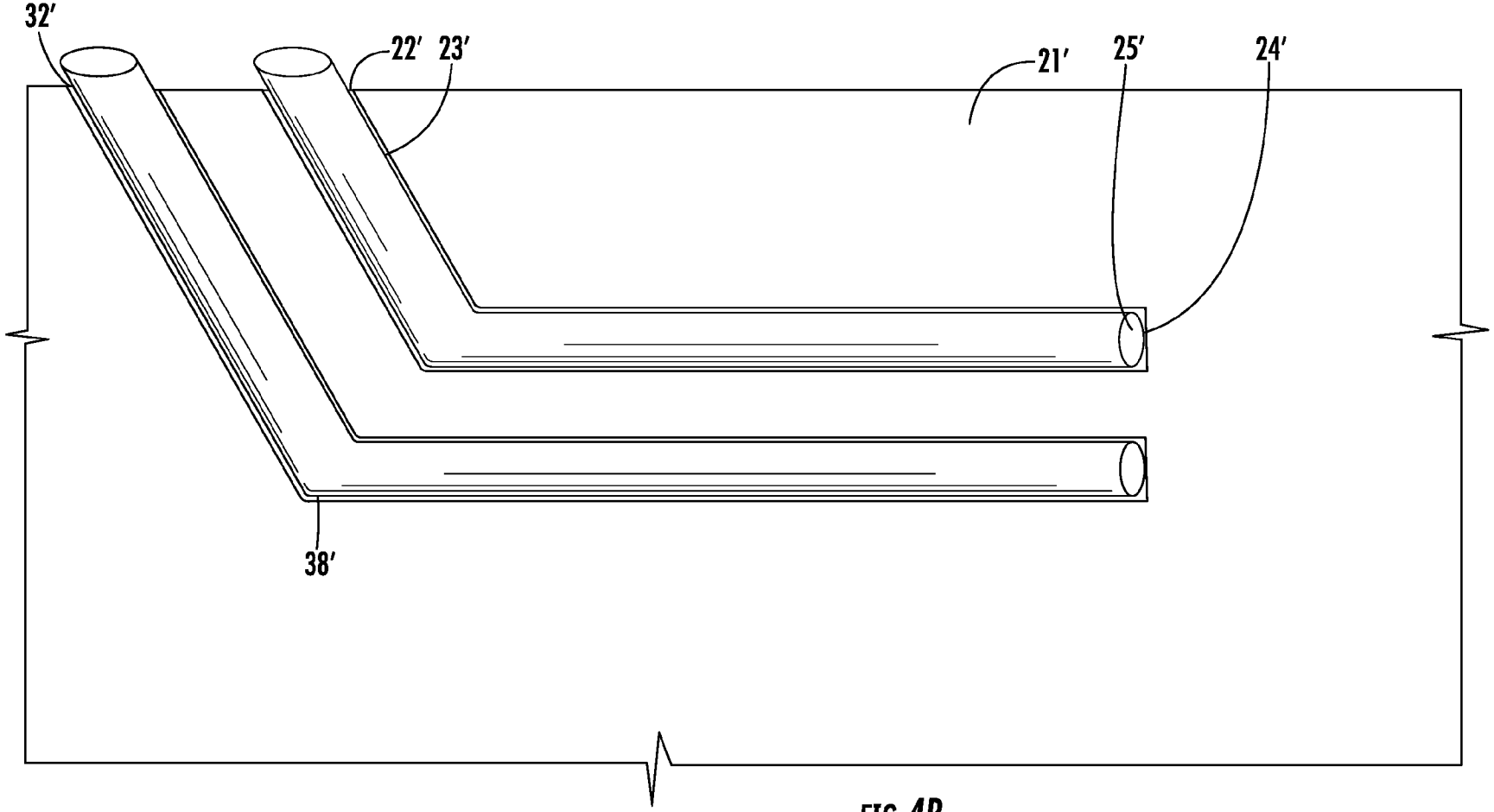

At Block 64, the method includes opening the closed distal end 25' of the tubular conductor 23'. Opening of the closed distal end 25' may be performed by drilling, for example. More particularly, a rotary drill bit from a rotary drilling rig above the subterranean formation 21' may be used to open or unseal the closed distal end 25' (FIG. 4*b*). The rotary drill assembly may, for instance, be guided through the existing tubular conductor 23' to reach the distal end 25'. Thus, any cap or seal may be ablated. Of course, other techniques, for opening the closed distal end 25', for example a hydraulic ram, swage, or a pyrotechnic device may be used for removal of an end cap, as will be appreciated by those skilled in the art.

Figure 4C:
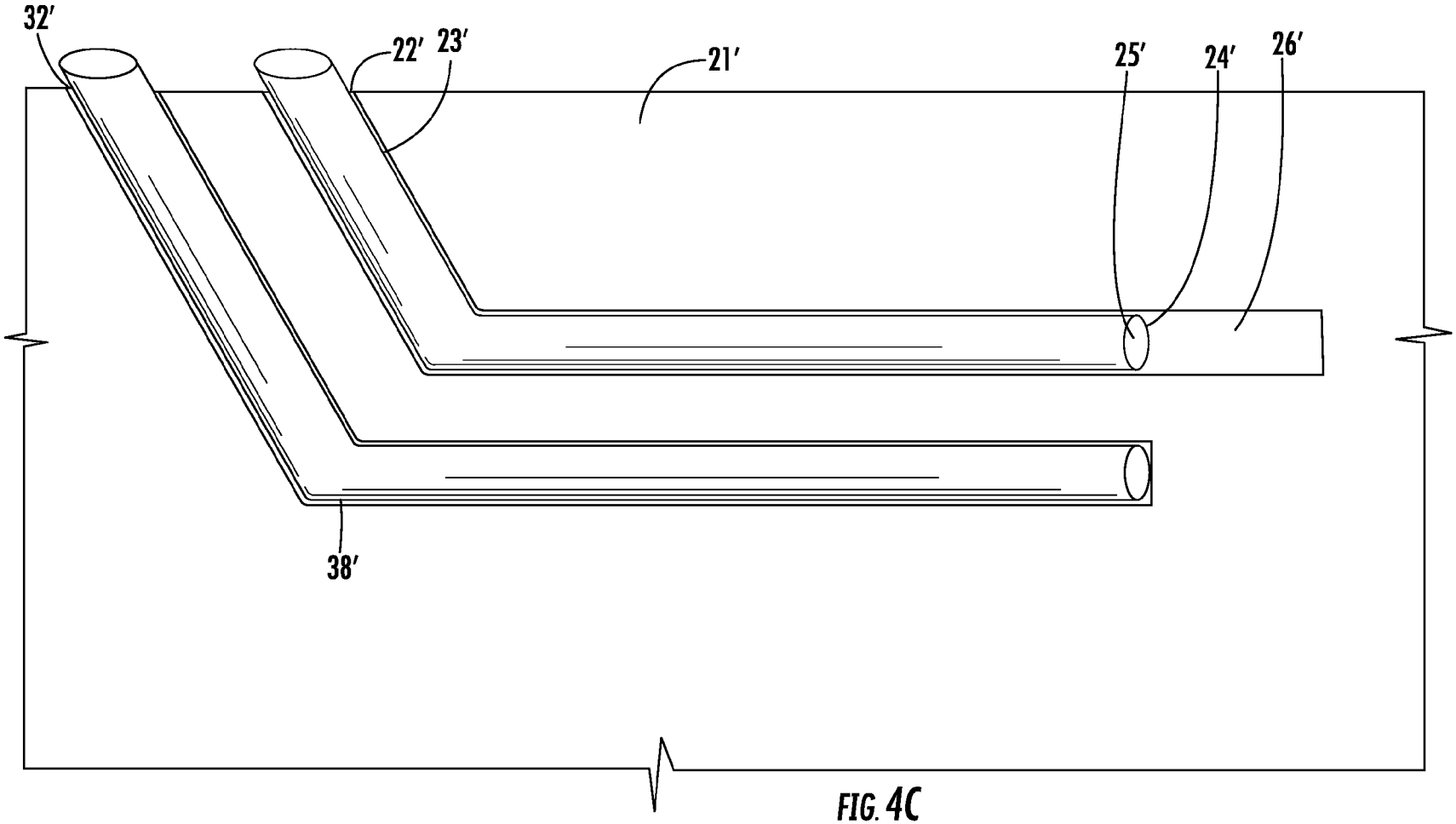

At Block 66, the method includes drilling outwardly from a distal end 24' of the injector well 22' beyond the distal end 25' of the tubular conductor 23' to define an extended injector well portion 26' (FIG. 4*c*). Various techniques for drilling may be used.

Figure 4D:
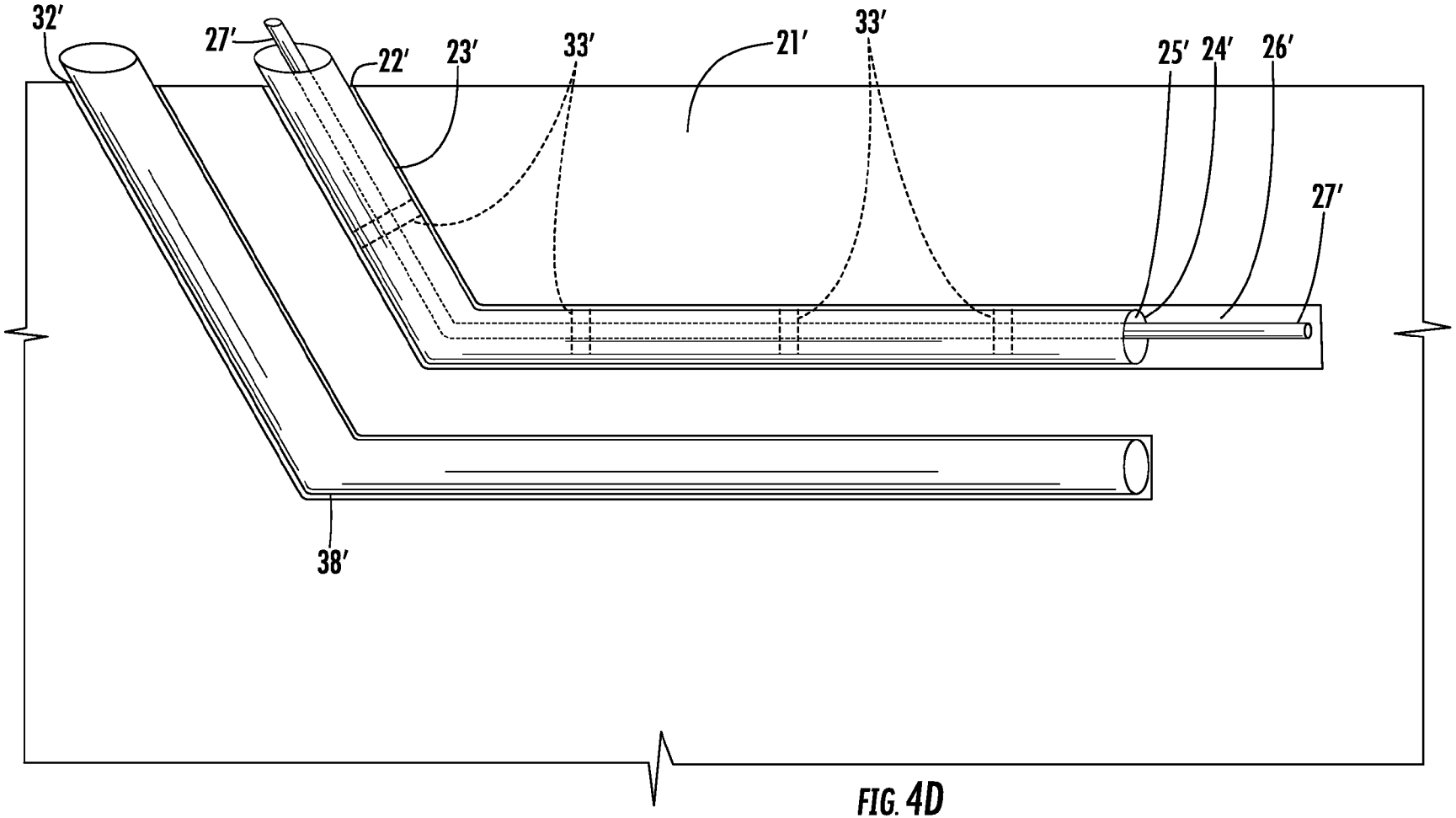

At Block 68, an RF conductor 27' is advanced through the tubular conductor 23' so as to extend beyond the distal end 25' of the tubular conductor and into the extended injector well portion 26' (FIG. 4*d*). Of course, more than one RF conductor 27' may be advanced through the tubular conductor 23'.

As noted above, the RF conductor 27' may be in the form of a conductive pipe or tube, a cable, a coaxial cable, or a litz wire, for example. The RF conductor 27' may be in other forms.

The method also includes, at Block 70, positioning dielectric spacers 33' to surround the RF conductor 27' (FIG. 4*d*). The dielectric spacers 33' may be tubular in shape, and may be positioned at regular intervals to surround the RF conductor 27' to aid in the advancement of the RF conductor through the tubular conductor 23'. The dielectric spacers 33' may also maintain spacing, for example, of a dielectric, e.g. air, between the tubular conductor 23' and the RF conductor 27'. The dielectric spacers 33' may be polytetrafluoroethylene (PTFE), for example. The dielectric spaces 33' may be another dielectric material.

The dielectric spacers 33' may be positioned in the tubular conductor 23' prior to advancing the RF conductor 27' or may be positioned to surround the RF conductor prior to advancement into the tubular conductor. The dielectric spacers 33' may be positioned and spaced in other configurations, and any number of dielectric spacers may be used.

Figure 4E:
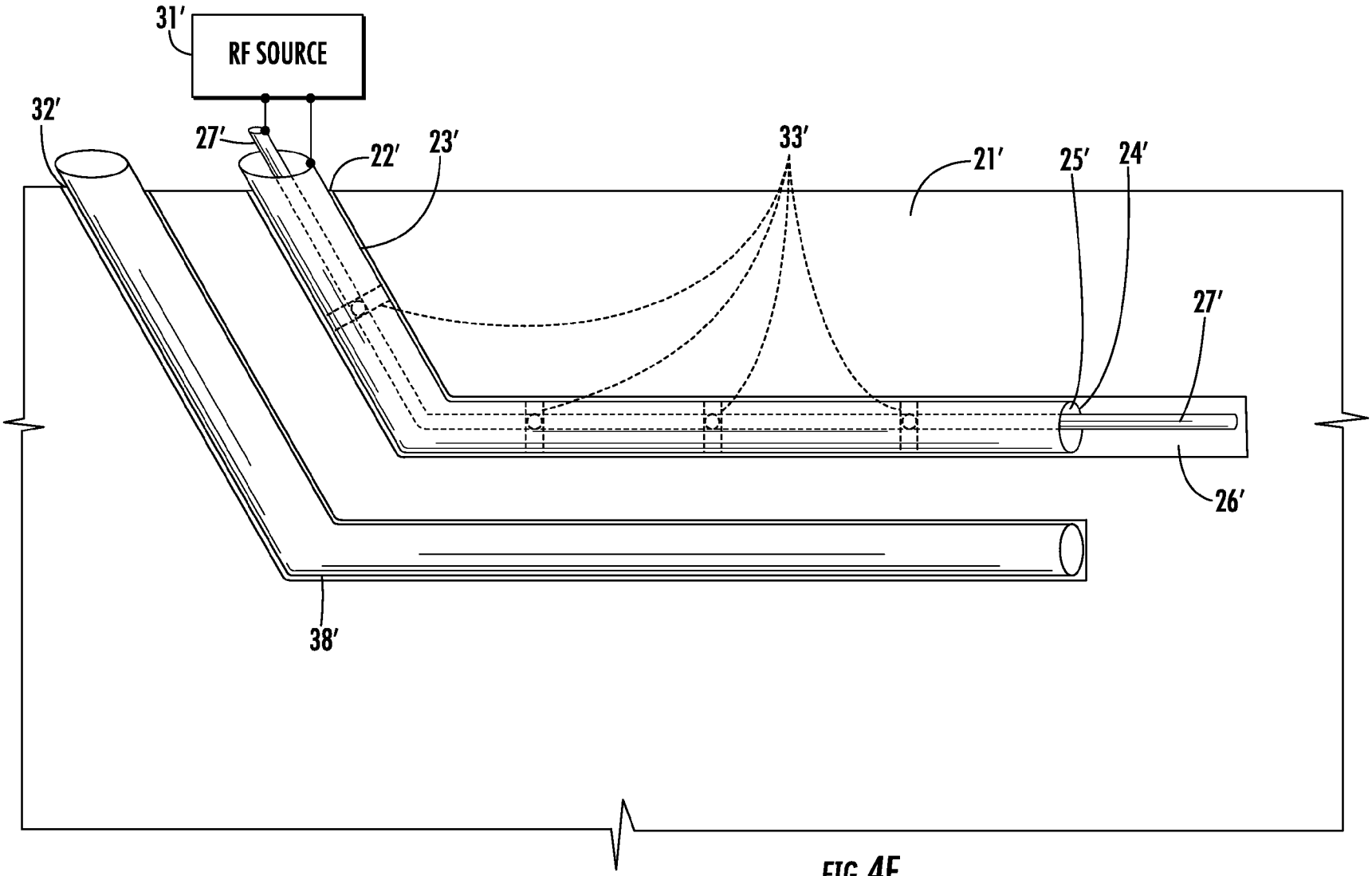

The method further includes, at Block 72, coupling an RF source 31' to the tubular conductor 23' and the RF conductor 27' (FIG. 4*e*). The RF source 31' may be positioned above the subterranean formation 21'.

The RF source 31' is coupled to the tubular conductor 23' and the RF conductor 27' so that RF energy is supplied into adjacent portions of the subterranean formation 21' from the RF conductor. Supplying RF energy may crack and upgrade the hydrocarbon resources in the adjacent portions of the subterranean formation 21'.

The tubular conductor 23' and the RF conductor 27' extending into the extended injector well portion 26' define an inset feed linear antenna. More particularly, RF electric currents flow on an outer surface of the tubular conductor 23' and cause it to define the antenna, or an RF applicator, in situ.

Figure 4F:
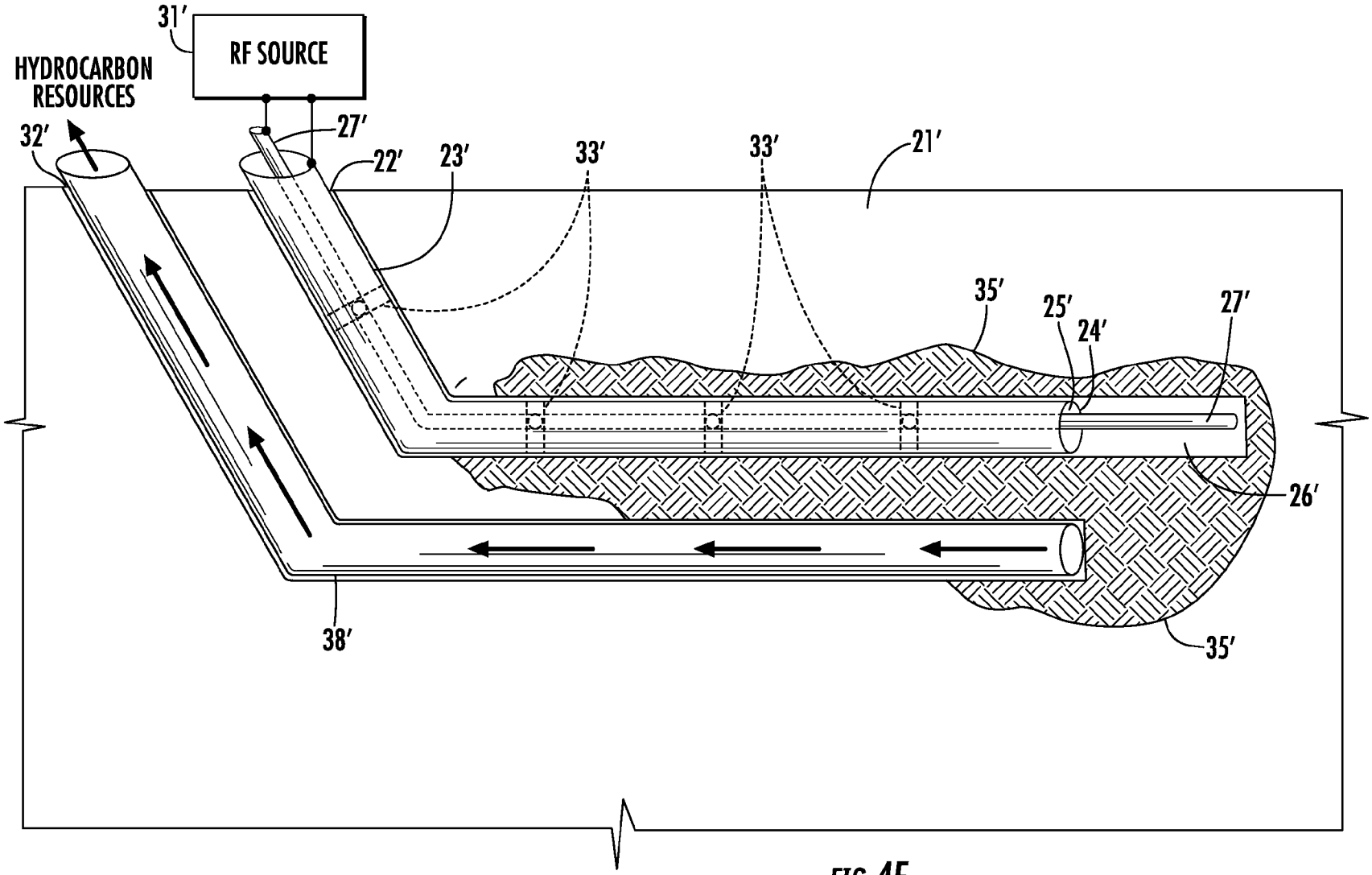

At Block 74, the method includes recovering hydrocarbon resources from the producer well 32' (FIG. 4*f*). As noted above, the hydrocarbon resources may be recovered using SAGD via the injector well 22' and the producer well 32'.

Current flows on an outer surface of the tubular conductor 23' and on the RF conductor 27' extending into the extended injector well portion 26' away from the RF source 31'. With respect to SAGD, in what is referred to as the steam saturation zone 35', the boiling temperature is reached along the surface of the tubular conductor 23' and the RF conductor 27' extending into the extended injector well portion 26'. Thus, the surrounding regions of the tubular conductor 23' and the RF conductor 27' extending into the extended injector well portion 26', i.e., the steam saturation zone 35', reduce the viscosity of the hydrocarbon resources by heating, and thus, may stimulate production. In other words, the present embodiment may cause radio frequency electric currents to crawl back over the outside of the tubular conductor 23' to heat the legacy regions of the well. This advantageously provides radio frequency heat along a legacy well pipe already installed. The method ends at Block 76.

Figure 5:
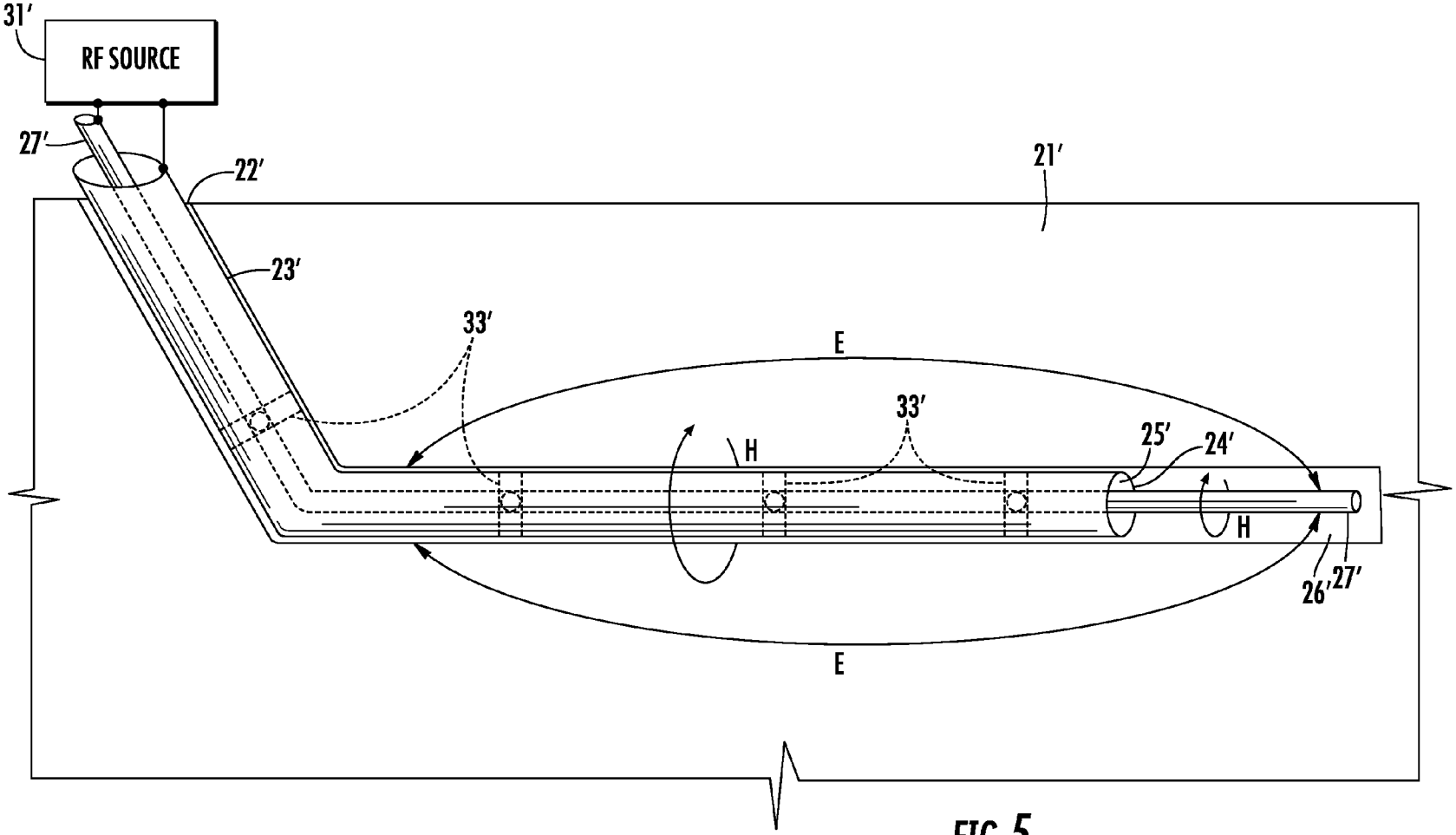
FIG. 5 is a cross-sectional view of the subterranean formation of FIG. 4*f* illustrating electric and magnetic fields along the tubular conductor and RF conductor in the injector well.

Referring additionally to FIG. 5, magnetic and electric fields with respect to the tubular conductor 23' and the RF conductor 27' are illustrated. The magnetic fields H break aromatic ring molecules into polar molecules. The electric fields E crack polar molecules into shorter carbon chain polar molecules. As will be appreciated by those skilled in the art, the electric and magnetic fields improve the viscosity of hydrocarbon resources and may, thus, upgrade the hydrocarbon resources.

Figure 6A:
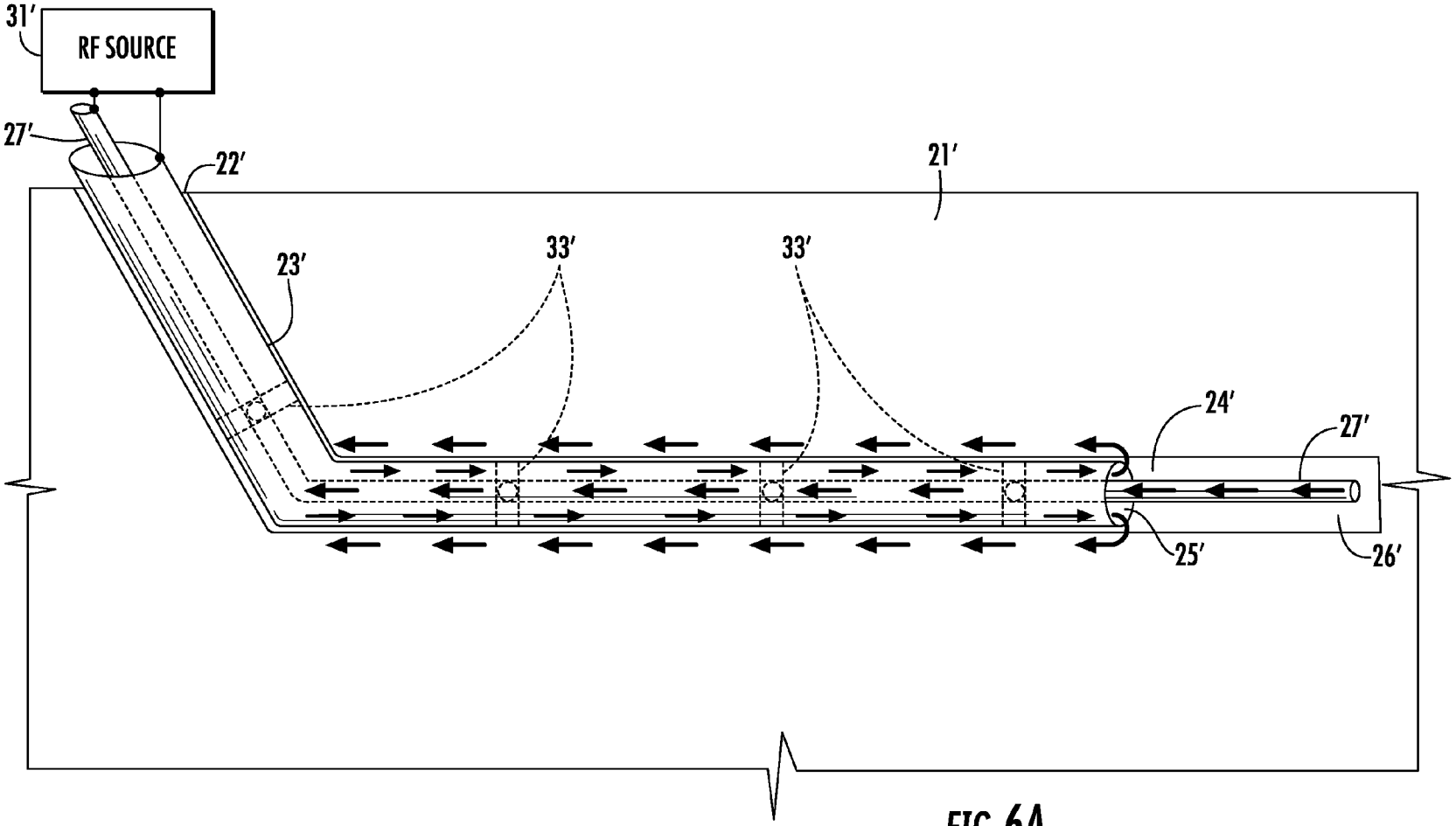
FIG. 6*a* is a cross-sectional view of the subterranean formation of FIG. 4*f* illustrating current flow along the tubular conductor and RF conductor in the injector well.

Referring now to FIG. 6*a*, currents are advantageously duplexed on the tubular conductor 23'. Illustratively, the currents travel outwardly from the RF source 31' along an inner surface of the tubular conductor 23'. Currents return to the RF source 31' along the outer surface of the tubular conductor 23'. Currents also return to the RF source 31' via the RF conductor 27'.

Figure 6B:
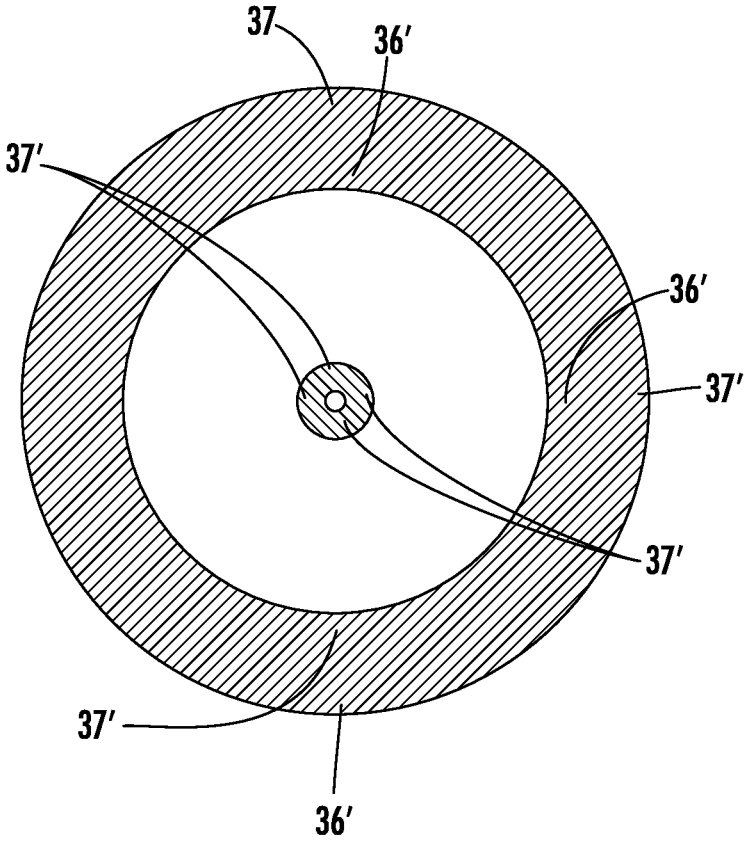
FIG. 6*b* is cross-sectional view of the tubular conductor and the RF conductor of FIG. 6*a*.

Referring now additionally to FIG. 6*b*, the current flow illustrated in FIG. 6*a* is further detailed by a cross-sectional view of the tubular conductor 23' and the RF conductor 27'.

Current flows outwardly, i.e., out of the page, at points 36'. Current flow inwardly, i.e. into the page, at points 37'.

As noted above, the tubular conductor 23' and the RF conductor 27' extending into the extended injector well portion 26' define an inset feed linear antenna when coupled to the RF source 31'. Inset feed antennas typically require anti-parallel, i.e. opposing direction, current flows, on the inside and the outside surfaces of the tubular conductor 23'. The anti-parallel currents may be provided by the magnetic permeability $\mu$ of the material of the tubular conductor 23', for example, steel, which may limit the current penetration depth, or by the conductivity a of the material of the tubular conductor which may cause the radio frequency skin effect. This may isolate the current flow on the inside and outside surfaces of the tubular conductor 23'. Even though the steel, for example, is electrically conductive, it may effectively behave as an insulator, internally, at RF frequencies due to the RF skin effect. Two directional current flows are thus formed on the tubular conductor 23', both internally and externally.

The combination of the tubular conductor 23' and the RF conductor 27' extending into the extended injector well portion 26' forms in the subterranean formation 21', a linear antenna akin to a dipole antenna. That is, the portion of the RF conductor 27' extending beyond the tubular conductor 23' is a half element of a linear dipole antenna and the portion of the RF conductor 27' within the tubular conductor is the other half element. Adjustments to the electrical resistance may be made by adjusting the ratio of the lengths of the RF conductor 27' within and extending beyond the tubular conductor 23'. A relatively low resistance may be obtained when the lengths of the RF conductor 27' within and extending beyond the tubular conductor 23' are approximately equal. A relatively high resistance may be obtained when the length of the RF conductor 27' within the tubular conductor 23' is largely greater than the lengths of the RF conductor extending beyond the tubular conductor, or when the lengths of the RF conductor extending beyond the tubular conductor is largely greater than the length of the RF conductor within tubular conductor.

The frequency of operation may be adjusted by adjusting the sum of the lengths of the RF conductor 27' within and extending beyond the tubular conductor 23'. In some embodiments, the antennas resonant frequency may be given by approximately by the sum of the lengths of the RF conductor 27' within and extending beyond the tubular conductor 23'$=c/2f\sqrt{\in_r}$ where f is the radio frequency of in Hertz and $\in_r$ is the relative dielectric permittivity of the subterranean formation 21'. The asymmetry of the dipole, may not affect this resonant frequency. Accordingly, independent adjustment of the frequency and resistance may be made by independent adjustment of the sum of the lengths of the RF conductor 27' within and extending beyond the tubular conductor 23' and the ratio of the lengths of the RF conductor within and extending beyond the tubular conductor.

The simulated electrical parameters of a example embodiment are described in Table 1:

TABLE 1

| Simulated Electrical Parameters Of An Example Embodiment | |
|---|---|
| Application | RF heating enhanced oil recovery |
| Well | Modified legacy SAGD well |
| The length of the RF conductor within the tubular conductor | |
| Hydrocarbon formation | Rich Athabasca oil sand, Fort McMurray |
| Hydrocarbon formation electrical conductivity | 0.002 mhos/meter |
| Hydrocarbon formation relative dielectric permittivity | 12 |
| Hydrocarbon formation bitumen concentration | 14% by weight |
| Water concentration in hydrocarbon formation | 1% by weight |
| The length of the RF conductor within the tubular conductor | 800 meters |
| The length of the RF conductor extending beyond the tubular conductor | 200 meters |
| Tubular conductor diameter | 0.25 meters |
| Radio frequency conductor diameter | 0.075 meters |
| Electrical impedance of the concentric tubes | 72 ohms |
| Initial well antenna resonant frequency | 3.98 MHz |
| Initial well-antenna impedance at resonance, | 92.3 + 0.3j ohms at 3.98 MHz |
| Voltage Standing Wave Ratio | Under 2 to 1 |
| Initial RF heating frequency | 3.98 Mhz |
| Applied RF power | Variable, 5 kilowatts per meter of well length in pay zone typical |

The realized temperatures in the hydrocarbon reservoir generally depend on the duration of the RF heating and the applied RF power level in Watts. The RF heating is thermally self regulating at the boiling temperature of water at reservoir pressure, and thus coking of the hydrocarbons typically does not occur. After warming, the hydrocarbon resources may be mobilized by the RF generated steam, injected steam, or gravity. The RF heating may be particularly reliable as rocks and shale strata typically cannot prevent the penetration of electromagnetic energy.

Figure 7:
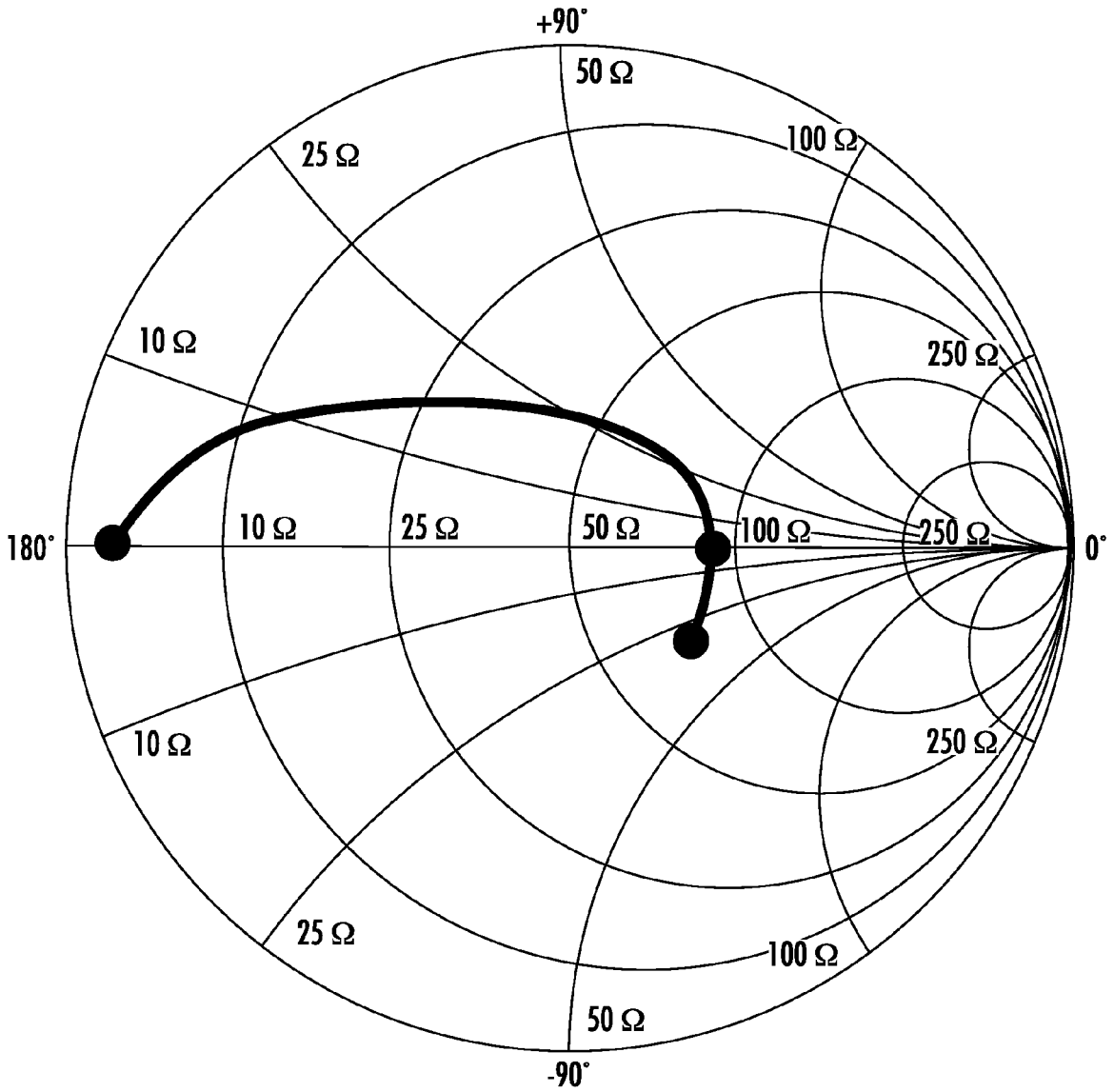
FIG. 7 is a Smith Chart of electrical impedance versus radio frequency according to an embodiment of the present invention.

FIG. 7 is a Smith Chart of the simulated initial electrical impedance versus radio frequency of the Table 1 example embodiment. As will be appreciated by those skilled in the art, resonance occurs near 4 MHz, which corresponds to a resistive electrical load of 92.3 Ohms. The location of the impedance plane is at the driving point, e.g. a distal end of the tubular conductor.

Figure 8:
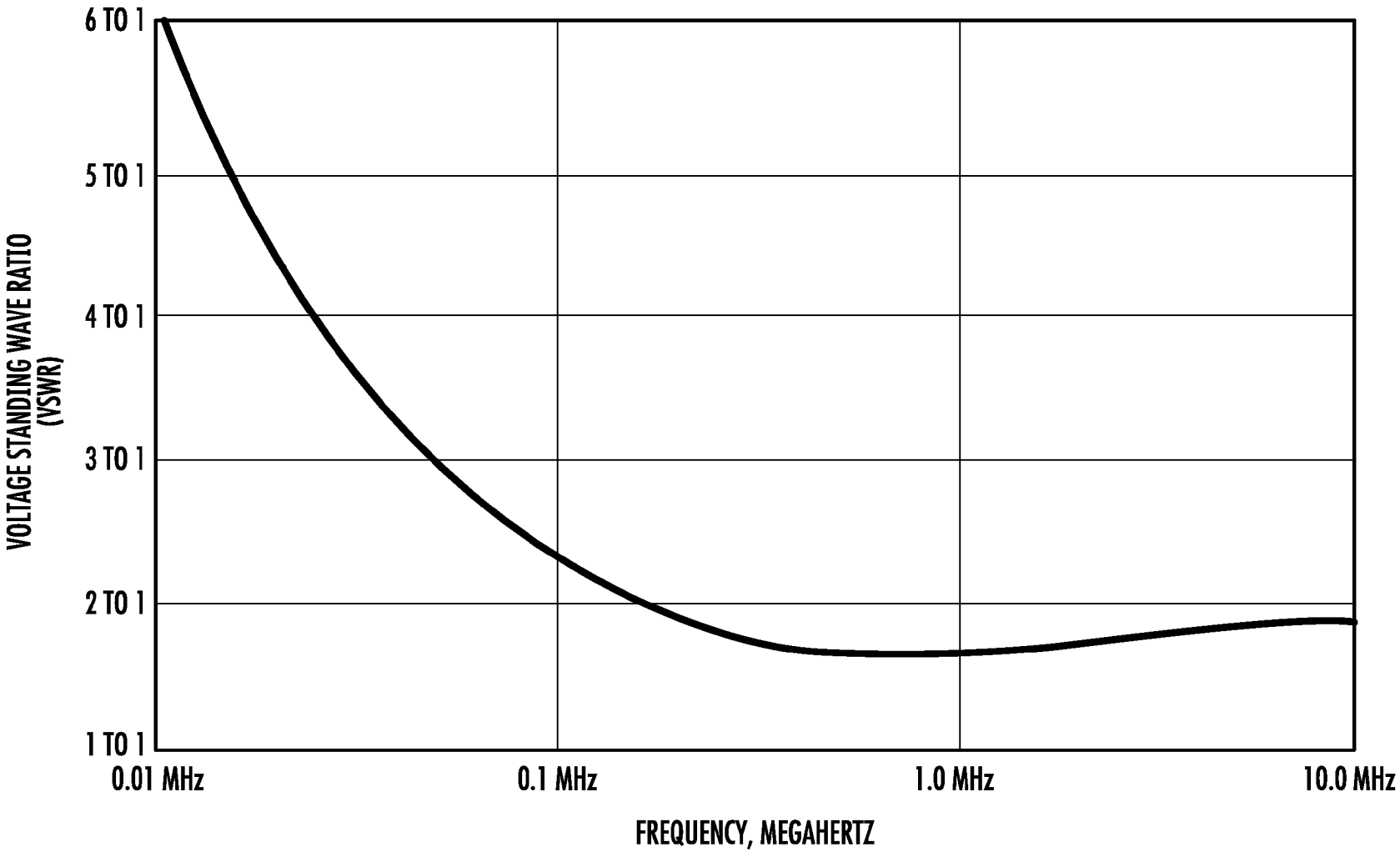
FIG. 8 is a graph of frequency versus voltage standing wave ratio (VSWR) according to an embodiment of the present invention.

FIG. 8 is a graph of the frequency versus voltage standing wave ratio (VSWR) of the Table 1 example embodiment in a 50 ohm system. An electrical load to the coaxial cable is formed by the concentric combination of tubular conductor and RF conductor.

Figure 9:
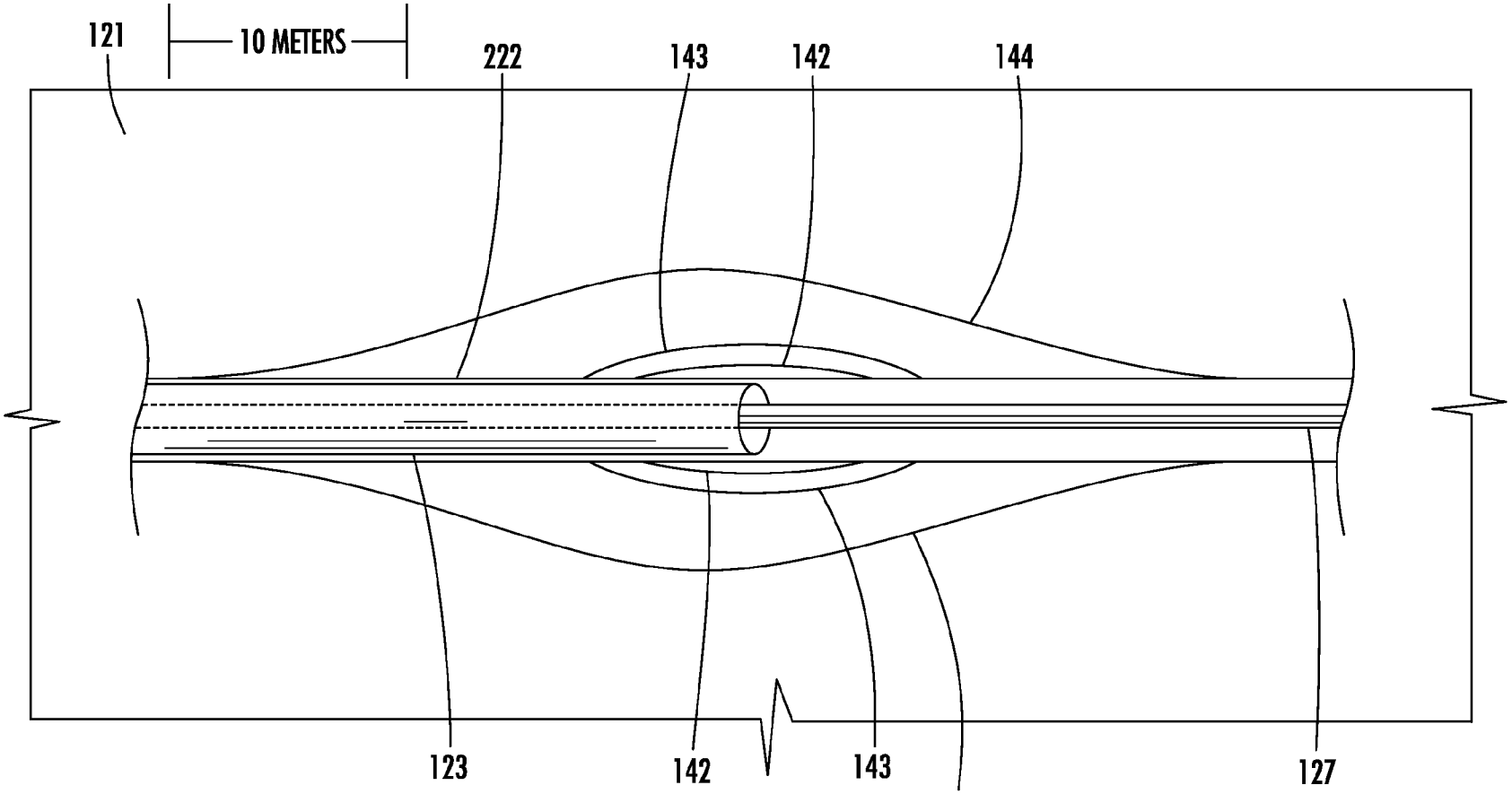
FIG. 9 is a cross-sectional view of a subterranean formation illustrating a heating pattern along a tubular conductor and an RE conductor in an injector well according to an embodiment of the present invention.

FIG. 9 is a cross-sectional view of a subterranean formation 121 illustrating the simulated heating pattern along a tubular conductor and an RF conductor 127 in the injector well 122. The heating pattern corresponds to the parameters in the Table 1 example embodiment at initial application of RF power. The radio frequency was 1 MHz and the applied power was 5 megawatts. Line 142 corresponds to 10,000 watts/meter$^3$. Line 143 corresponds to 1,000 watts/meter$^3$, and line 144 corresponds to 100 watts/meter$^3$.

The plotted quantity is the specific absorption rate in the hydrocarbon ore in watts/meter cubed. As the heating is allowed to continue, the heating energy spreads beyond the illustrated areas so that in time the distal end of the RF conductor 227 receives the RF heating energy as the connate water is boiled off the surface. The RF heating continues after the liquid water contact ends. The tubular conductor 123 typically does not get appreciably hotter than the surrounding oil sands, and do not appreciably conduct heat into the hydrocarbon ore. The realized temperatures may be varied by the applied power level and the duration of the heating. In one embodiment the temperatures thermally regulate at the water boiling point at reservoir conditions, although it is typically not necessary to heat to the boiling point. Steam typically does not appreciably heat by radio frequency energy while liquid water does.

Figure 10:
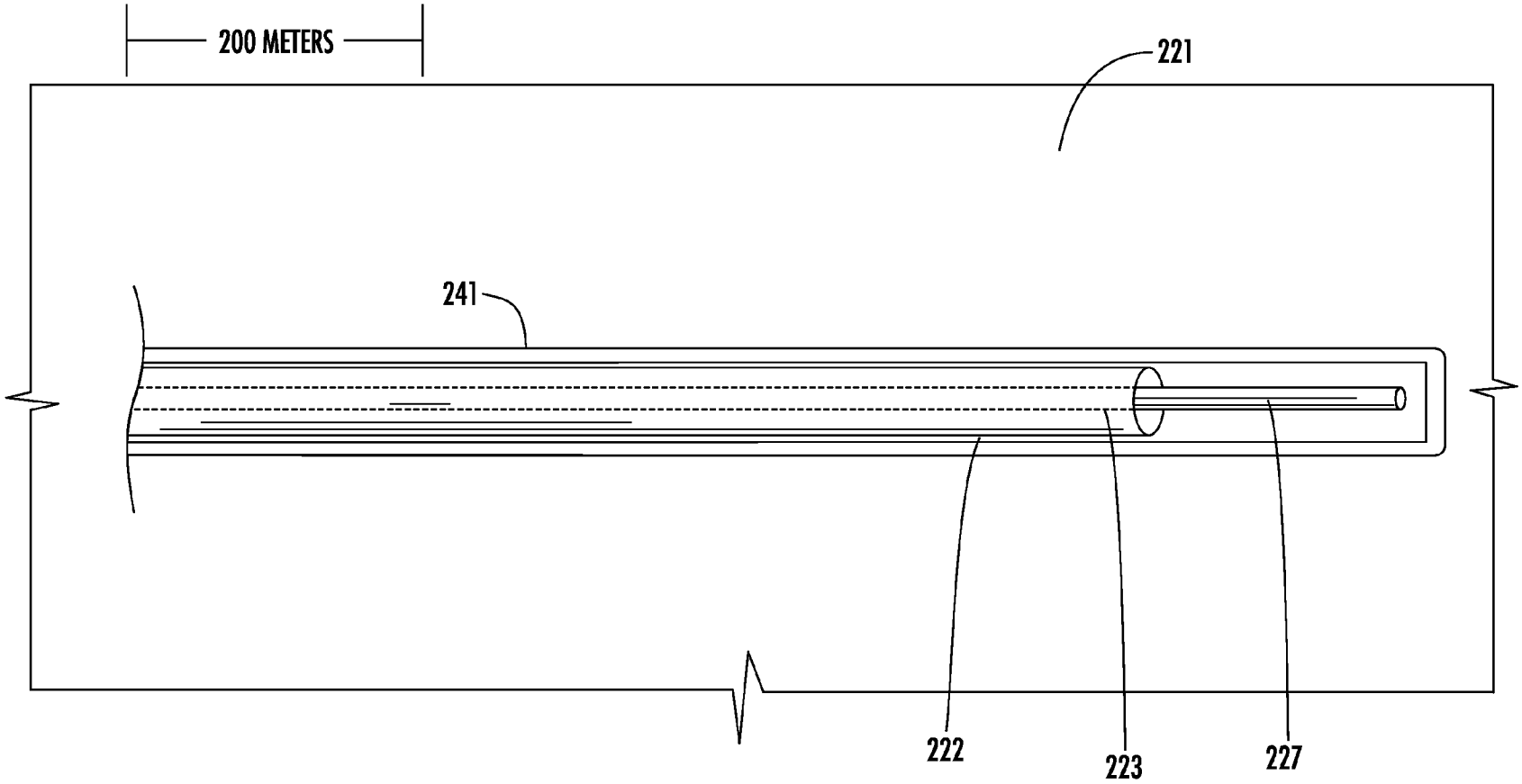
FIG. 10 is a cross-sectional view of a subterranean formation illustrating a temperature pattern along a tubular conductor and an RF conductor in the injector well according to an embodiment of the present invention.

FIG. 10 is a cross-sectional view of a subterranean formation 221 illustrating the simulated underground temperature pattern along a tubular conductor 223 and an RF conductor 227 in the injector well 222 after RE heating. An elongate steam saturation zone 241 is along the RF conductor 227. Inside the elongate steam saturation zone 241, the temperatures typically rise to the boiling temperature of water, and these temperatures may range from 200 to 280° C. in formations of rich Athabasca oil sands at depths of hundreds of meters, for example. The steam saturation zone 241 may be cylindrical or the shape of a greatly elongated football, for example. Outside the steam saturation zone 241, a temperature gradient extends radially away from the RF conductor 227 and the tubular conductor 223. The slope of this temperature gradient may be adjusted by the applied RE power level in Watts. The product of the specific heat of the ore and the applied energy may determine the temperature. In one concept of operation, oil or bitumen melts off the wall of the steam saturation zone, e.g. an advancing heat and production front is progresses radially away from the tubular conductor 223 and RF conductor 227. Other production approaches may of course be used, such as, for example, gentle warming at lower power levels.

As will be appreciated by those skilled in the art, the method described herein may be used with various hydrocarbon resource processing devices. Further details of an exemplary hydrocarbon resources processing device for use with the methods described herein are described in co-pending U.S. application Ser. No. 12/878,774, the entire contents of which are herein incorporated in their entirety by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for hydrocarbon resource recovery in a subterranean formation comprising an originally drilled laterally extending injector well having a tubular conductor therein, and a laterally extending producer well adjacent the injector well, the originally drilled laterally extending injector well having been drilled at a first drilling and laterally extending producer well having originally been used in recovery of hydrocarbon resources during a first hydrocarbon resource recovery after the first drilling, the method comprising:

drilling outwardly, at a second drilling, from a distal end of the originally drilled injector well beyond a distal end of the tubular conductor to define an extended injector well portion, the second drilling being after the first hydrocarbon resource recovery has stopped and after the first drilling;

advancing a radio frequency (RF) conductor through the tubular conductor so as to extend beyond the distal end of the tubular conductor and into the extended injector well portion;

supplying RF energy into adjacent portions of the subterranean formation from the RF conductor; and recovering additional hydrocarbon resources, during a second hydrocarbon resource recovery and after the second drilling, utilizing the producer well.

2. The method according to claim 1, wherein supplying RF energy comprises supplying RF energy to upgrade the hydrocarbon resources in the adjacent portions of the subterranean formation.

3. The method according to claim 1, wherein supplying RF energy further comprises coupling an RF source to the tubular conductor and the at least one RF conductor.

4. The method according to claim 1, further comprising positioning at least one dielectric spacer to surround the RF conductor.

5. The method according to claim 1, wherein recovering hydrocarbon resources comprises recovering hydrocarbon resources using Steam Assisted Gravity Drainage (SAGD) using the injector well and producer well.

6. The method according to claim 1, wherein the distal end of the tubular conductor is closed; and further comprising opening the closed distal end.

7. The method according to claim 1, wherein the subterranean formation comprises an oil sand formation.

8. A method of heating a hydrocarbon resource in a subterranean formation comprising an originally drilled laterally extending well having a tubular conductor therein, the originally drilled laterally extending well having been drilled at a first drilling and originally been used in recovery of hydrocarbon resources during a hydrocarbon resource recovery after the first drilling, the method comprising:

drilling outwardly, at a second drilling, from a distal end of the originally drilled laterally extending well beyond a distal end of the tubular conductor to define an extended well portion, the second drilling being after the hydrocarbon resource recovery has stopped and after the first drilling;

advancing a radio frequency (RF) conductor through the tubular conductor so as to extend beyond the distal end of the tubular conductor and into the extended well portion; and supplying RF energy into adjacent portions of the subterranean formation from the RF conductor to heat the hydrocarbon resources.

9. The method according to claim 8, wherein supplying RF energy comprises supplying RF energy to upgrade the hydrocarbon resources in the adjacent portions of the subterranean formation.

10. The method according to claim 8, wherein supplying RF energy further comprises coupling an RF source to the tubular conductor and the RF conductor.

11. The method according to claim 8, further comprising positioning at least one dielectric spacer to surround the at least one RF conductor.

12. The method according to claim 8, wherein the distal end of the tubular conductor is closed; and further comprising opening the closed distal end.

13. The method according to claim 8, wherein the subterranean formation comprises an oil sand formation.

14. A method for hydrocarbon resource recovery in a subterranean formation comprising an originally drilled laterally extending injector well having a tubular conductor therein, and a laterally extending producer well adjacent the injector well, the originally drilled laterally extending injector well having been drilled at a first drilling and laterally extending producer well having originally been used in recovery of hydrocarbon resources during a first hydrocarbon resource recovery after the first drilling, the method comprising:

drilling outwardly, at a second drilling, from a distal end of the originally drilled injector well beyond a distal end of the tubular conductor to define an extended injector well portion, the second drilling being after the first hydrocarbon resource recovery has stopped and after the first drilling;

advancing a radio frequency (RF) conductor through the tubular conductor so as to extend beyond the distal end of the tubular conductor and into the extended injector well portion;

positioning at least one dielectric spacer to surround the RF conductor;

supplying RF energy to upgrade the hydrocarbon resources into adjacent portions of the subterranean formation from the RF conductor; and recovering additional hydrocarbon resources, during a second hydrocarbon resource recovery and after the second drilling, using the producer well.

15. The method according to claim 14, wherein supplying RF energy further comprises coupling an RF source to the tubular conductor and the at least one RF conductor.

16. The method according to claim 14, wherein recovering hydrocarbon resources comprises recovering hydrocarbon resources using Steam Assisted Gravity Drainage (SAGD) using the injector well and producer well.

17. The method according to claim 14, wherein the distal end of the tubular conductor is closed; and further comprising opening the closed distal end.

18. The method according to claim 14, wherein the subterranean formation comprises an oil sand formation.

* * * * *